US008794025B2

(12) United States Patent
Rugeris

(10) Patent No.: US 8,794,025 B2
(45) Date of Patent: Aug. 5, 2014

(54) APPARATUS FOR PREPARING COLOURED ICE CUBES

(75) Inventor: Jess Edward Rugeris, West Molesey (GB)

(73) Assignee: Ecochroma AG, Zurich (CH)

( * ) Notice: Subject to any disclaimer, the term of this patent is extended or adjusted under 35 U.S.C. 154(b) by 1195 days.

(21) Appl. No.: 12/639,538

(22) Filed: Dec. 16, 2009

(65) Prior Publication Data

US 2011/0120153 A1 May 26, 2011

(30) Foreign Application Priority Data

Jun. 5, 2009 (EP) ..... 09007451

(51) Int. Cl.
*F25C 5/08* (2006.01)
*F25C 1/00* (2006.01)
*F25C 5/16* (2006.01)

(52) U.S. Cl.
CPC ..... *F25C 1/00* (2013.01); *F25C 2301/00* (2013.01)
USPC ..... 62/349; 62/1; 62/340

(58) Field of Classification Search
CPC ..... F25C 1/00; F25C 2301/00; F25C 5/08; F25C 5/16; A23G 9/00
USPC ..... 62/348, 3.63
See application file for complete search history.

(56) References Cited

U.S. PATENT DOCUMENTS 2,806,357 A * 9/1957 Pichler ..... 62/138
2,940,276 A * 6/1960 Loewenthal et al. ..... 62/138
5,958,481 A 9/1999 Hodges
6,342,261 B1 1/2002 Spencer
6,513,337 B1 2/2003 Astvatsatrian et al.
6,713,101 B2 3/2004 Lometillo et al.
6,960,360 B2 11/2005 Gourdin et al.
2002/0020177 A1 * 2/2002 Billman et al. ..... 62/135
2003/0082281 A1 5/2003 Kohler et al.

(Continued)

FOREIGN PATENT DOCUMENTS

EP 20090002501 9/2010
GB 1498205 1/1978

(Continued)

OTHER PUBLICATIONS

Lesson Plan 16, Cool Chemistry—DIY pH Indicator (Red Cabbage) ABC Science Online, posted on 2007, 13 pages.
U.S. Appl. No. 12/639,544, filed Dec. 16, 2009, In re: Rugeris, entitled *Food Grade Colouring Agent*.
U.S. Appl. No. 12/639,526, filed Dec. 16, 2009, In re: Rugeris, entitled *Food Grade Colouring Agent*.
Duangmal, K., et al.; "Colour Evaluation of Freeze-Dried Roselle Extract as a Natural Food Colorant in a Model System of a Drink"; LWT—Food Science and Technology; vol. 41; Issue 8; Nov. 2008; pp. 1437-1445.

(Continued)

*Primary Examiner* — Ljiljana Ciric
*Assistant Examiner* — Alexis Cox
(74) *Attorney, Agent, or Firm* — Sughrue Mion, PLLC

(57) ABSTRACT

An apparatus for the preparation of colored ice cubes (100, 100', 100") comprising: a connection for a water supply (10), a heater (20), a single cooler (30), an array of two or more color recipients (50, 50', 50"), two or more associated mixers (60, 60', 60") for mixing the colored water from the recipients (50, 50', 50") with water from the single cooler (30), and at least one freezer (70, 70', 70") for preparing colored ice cubes (100, 100', 100"), which is connected to the outlets of the mixers (60, 60', 60"). Further a method for operating the apparatus for the preparation of colored ice cubes is presented.

19 Claims, 3 Drawing Sheets

(56) References Cited

U.S. PATENT DOCUMENTS

| | | | | |
|---|---|---|---|---|
| 2003/0124235 | A1 | 7/2003 | Yukawa et al. | |
| 2004/0121050 | A1 | 6/2004 | Thurman et al. | |
| 2006/0086135 | A1* | 4/2006 | Wu et al. | 62/351 |
| 2006/0254300 | A1* | 11/2006 | Rugeris | 62/340 |
| 2006/0288726 | A1* | 12/2006 | Mori et al. | 62/351 |
| 2008/0006035 | A1* | 1/2008 | Rugeris | 62/1 |
| 2008/0075824 | A1 | 3/2008 | Biehl | |
| 2009/0192231 | A1 | 7/2009 | Lemons | |

FOREIGN PATENT DOCUMENTS

| | | | |
|---|---|---|---|
| GB | 2387896 | | 10/2003 |
| WO | WO-00/17589 | | 3/2000 |
| WO | WO 03/024251 | A1 | 3/2003 |
| WO | WO 2004/081467 | A2 | 9/2004 |

OTHER PUBLICATIONS

Katz, David A., "Determining pH with Red Cabbage Paper"; © 2006; [Online]; Retrieved from the Internet <URL: http://www.chymist.com/Acids%20and%20bases%20with%20red%20cabbage.pdf.

"Red Cabbage and Lemon"; Way Back Machine dated Apr. 1, 2008; Cited on Form PTO-892 and included with Office Action issued in U.S. Appl. No. 12/639,544, mailed Jun. 22, 2011.

"Ice Cubes"; Way Back Machine dated Oct. 11, 2008; Cited on Form PTO-892 and included with Office Action issued in U.S. Appl. No. 12/639,544, mailed Jun. 22, 2011.

"Red Cabbage and Food Color"; dated Feb. 24, 2010; Cited on Form PTO-892 and included with Office Action issued in U.S. Appl. No. 12/639,544, mailed Jun. 22, 2011.

Fellows Food Processing Technology: Principles and Practice Second Edition, Woodhead Publishing Limited 2000, pp. 98, 311, 335, 441, 442, 462, 463, 467, and 470.

* cited by examiner

APPARATUS FOR PREPARING COLOURED ICE CUBES

FIELD OF THE INVENTION

The present invention relates to an apparatus for the preparation of coloured ice cubes and to a method for operating said apparatus.

BACKGROUND OF THE INVENTION

Ice cubes currently find wide application in the beverage industry, primarily for cooling beverages. Ice cubes are produced domestically by filling an ice cube tray with water and placing it in a freezer. Many domestic freezers are nowadays also equipped with an icemaker, which produces ice cubes automatically and stores them in a bin, from which they can be dispensed directly into a glass. Ice cubes are also produced commercially and sold in bulk; these ice cubes are often cylindrical, and may also have holes through the centre.

Examples of domestic and commercial ice cube machines are described in GB 1 498 205 and GB 2 387 896, for instance.

In addition to the mere cooling effect, ice cubes can also be produced in various colours and shapes in order to enhance the aesthetic properties. In this respect, WO 00/17589 describes a process for producing coloured ice cubes, wherein a colouring agent is added and mixed with pre-treated water, which is then frozen.

U.S. Pat. No. 6,513,337 discloses a system for the preparation of coloured ice cubes in various shapes. By means of a control unit, a selected colour is dispensed from a dye reservoir into a mixing chamber, mixed with water and chilled. The coloured water is then supplied to an ice tray to afford ice cubes of various shapes.

WO 2004/081467 relates to an ice-making apparatus for the preparation of coloured and/or specially shaped ice cubes. The apparatus comprises a water delivery means, a colouring station to impart colour to the water, a freezing station for forming blocks of coloured ice and a storage means for presenting the coloured ice. This ice-making apparatus allows for the simultaneous preparation of ice cubes of different colours: The water is introduced into an array of colouring stations, each comprising a colouring agent and optionally a heating means, and the coloured water thus obtained is supplied to an array of freezing stations, where the ice cubes are formed.

It is a problem of the present invention to provide an apparatus for a simple, efficient, and cost effective preparation of coloured ice cubes, and in particular for the preparation of ice cubes in two or more different colours.

SUMMARY OF THE INVENTION

The problem is solved by the apparatus according to the present invention and the method for operating the apparatus described herein. Further preferred embodiments are also described below.

The apparatus of the present invention comprises a connection for a water supply, a heating means, a cooling means, an array of two or more colour recipients, and at least one freezing means for preparing coloured ice cubes. The heating means is connected to the connection for the water supply for feeding the heating means with water and comprises a water outlet for discharging hot water. The two or more colour recipients are intended for receiving a colouring agent and each comprise a water inlet and a water outlet for discharging coloured water. The water outlet of the heating means is connected to each of the water inlets of the colour recipients for feeding the colour recipients with hot water. The cooling means is connected to the connection for the water supply for feeding the cooling means with water and comprises a water outlet for discharging cooled water. The at least one freezing means is connected to the water outlet of the cooling means and to at least one of the water outlets of the colour recipients.

Throughout this application, two components of the apparatus, which are said to be "connected", may be connected by a direct or an indirect connection, which allows for the transfer of water and/or ice. In the case of an indirect connection, one or several intermediate components may be arranged between the two connected components, with the water or ice flow from one component to the other passing the intermediate component(s).

The apparatus of the present invention allows for a very effective preparation of coloured ice cubes: At least part of the supplied water is heated in a central heating means and the two or more colouring means are supplied with the hot water, thereby significantly enhancing the staining properties. Thus, instead of a separate heating means for each colour, the apparatus of the present invention comprises one single, central heating means. Therefore, the heating and colouring is substantially more efficient than in the ice-making apparatus of WO 2004/081467: Separate heating means for each colour recipient lead to higher acquisition and energy costs and require insulation of each colour recipient. In addition, it is energetically more favourable to heat one large volume of water than to heat several small ones, as the heat transfer to the surroundings via the surface is proportionally reduced in the case of a single volume. Furthermore, according to the present invention, the heating means is only in contact with pure water, whereas the heating means of WO 2004/081467 are in contact with coloured water and thus much more susceptible to staining, causing additional cleaning costs.

In the cooling means, the water is centrally cooled before the actual freezing process, such that the energy needed by the freezing means is minimized, as well as the freezing time. In addition, it is energetically more favourable to cool one large volume of water than to cool several small ones, as the heat transfer from the surroundings via the surface is proportionally reduced in the case of a single volume.

The water supply, a connection to which the apparatus of the present invention comprises, is typically a cold water supply, preferably of a public water supply.

The heating means allows for heating the water to a temperature of at least 45° C., preferably of at least 70° C., and more preferably of at least 90° C. In addition, the heating means also serves for cleaning and disinfection purposes. In a preferred embodiment, the heating means comprises a heating tank. Such a heating tank allows for accumulating a certain amount of cold water from the water supply, which is heated to the desired temperature and may also be stored in the heating tank, if desired. Preferably, the heating tank is insulated to avoid heat loss to its surroundings.

In the cooling means, the water is typically cooled to a temperature of less than 30° C., preferably less than 10° C., more preferably less than 5° C. In a preferred embodiment, the cooling means comprises a cooling tank. Such a cooling tank allows for accumulating a certain amount of water, which is cooled to the desired temperature and may also be stored in the cooling tank, if desired. Preferably, the cooling tank is insulated to minimize heat transfer from the surroundings.

The heating and cooling tank, if applicable, may have a common wall, which is preferably well insulated to avoid heat transfer between the two tanks.

The colour recipients allow for the preparation of coloured water. Preferably, each colour recipient provides water of a different colour. The coloured water produced in the colour recipients is relatively concentrated and is diluted with the cooled water from the cooling means to the desired shade and concentration of colour.

In a preferred embodiment, the water inlet of the cooling means is connected to the water outlet of the heating means. Thus, the water supplied to the apparatus is centrally heated in the heating means and then fed to the colour recipients and the cooling means. Thanks to the connection between the heating and the cooling means, it is possible to use unprocessed water for the preparation of the ice cubes, which is heated in the heating means for purification and disinfection and then further processed in the colour recipients and cooling means, respectively. Preferably, only a relatively small amount of hot water is led to the colour recipients, whereas the main part of the hot water is led to the cooling means. Preferably, at least 90% of the hot water is led to the cooling means, more preferably at least 95% and most preferably at least 99% of the hot water is led to the cooling means. For instance, approximately 8000 or 9000 ml of hot water is led to the cooling means, whereas only 1 ml of hot water is led to the colour recipients.

In a preferred embodiment, the apparatus of the present invention further comprises one or more water pumps for pumping the water from the heating means to the colour recipients and/or from the cooling means to the freezing means and/or, if applicable, from the heating means to the cooling means. The water pumps allow for an efficient transfer of the water from one component of the apparatus to another. In addition, thanks to the water pumps, it is possible to arrange the heavy components, such as the heating or cooling tank, for instance, in the lower region, preferably at the bottom, of the apparatus. Alternatively, it is also possible that the difference in level of the different components is used for transferring the water, instead of the water pumps.

The apparatus of the present invention comprises at least one freezing means, which is connected to at least one of the water outlets of the colour recipients. In the case of a single freezing means, it is possible to prepare ice cubes of different colours sequentially, by supplying the freezing means with coloured water from one by one of the two or more colour recipients. A single freezing means should be connected to each of the water outlets of the colour recipients.

In a preferred embodiment, the apparatus comprises an array of two or more freezing means. An array of two or more freezing means allows for the simultaneous preparation of ice cubes of two or more different colours.

Preferably, the freezing means is/are connected to at least two of the water outlets of the colour recipients. More preferably, each freezing means is connected to all water outlets of the colour recipients. In this embodiment, it is possible to prepare ice cubes of different colours in the same freezing means by supplying the freezing means sequentially with coloured water from two or more colour recipients. This allows for maximal flexibility with regard to the colour and amount of the ice cubes prepared. Furthermore, it is not necessary to have as many freezing means as there are colour recipients: It is, for instance, possible that each freezing means is connected to two colour recipients, preferably supplying water of similar colours, and is used for sequentially preparing ice cubes of two different colours. In addition, this arrangement also allows for the preparation of bi- or multicoloured ice cubes. In this case, a freezing means is also sequentially supplied with coloured water from two or more different colour recipients, but the ice cubes formed in the freezing means are not discharged between two different colours. Thereby, multicoloured ice cubes with two ore more layers of different colours can be prepared.

Alternatively, in the case of an equal number of colour recipients and freezing means, it is also possible that each freezing means is connected to only one colour recipient and vice versa. In this case, each freezing means is used for the preparation of ice cubes of one single colour and blending of the colours is avoided completely. Therefore, the cleaning requirements are minimized.

In a preferred embodiment, the freezing means comprises at least one freezing chamber, preferably an array of two or more freezing chambers. Most preferably, in the case of an array of two or more freezing means, each freezing means comprises a freezing chamber. The freezing chamber(s) allow(s) for accumulating a certain amount of cooled and coloured water in the freezing chamber(s) for the preparation of coloured ice cubes, and, if desired, for storing the cooled and coloured water therein. Preferably, the freezing chamber(s) is/are well insulated to avoid heat transfer from the surroundings.

In a preferred embodiment, the apparatus of the present invention further comprises at least one mixing means for mixing the coloured water with the cooled water, preferably an array of two or more mixing means. The mixing means guarantees a uniform mixture of the coloured and cooled water and thus a uniform colouring of the ice cubes. Preferably, the apparatus comprises an equal number of colour recipients and mixing means, such that there is a separate mixing means for each colour. In a different preferred embodiment, the apparatus comprises an equal number of freezing means and mixing means. Alternatively, it is also possible to have a single, central mixing means, which is intended to be sequentially charged with coloured water from different colour recipients.

Preferably, the mixings means is arranged within a mixing chamber or, if applicable, within a freezing chamber. A mixing chamber allows for accumulating a certain amount of cooled and coloured water before mixing it and, if desired, for storing the cooled and coloured water. Most preferably, the apparatus comprises an equal number of freezing means and mixing means, with each mixing means being associated to one freezing means and being arranged within the pertinent freezing chamber. Alternatively, it is also possible to have both one or more mixings means arranged within a mixing chamber and one or more mixings means arranged within a freezing chamber. This allows for an efficient mixing of the cooled and coloured water prior to its introduction into the freezing means and for an additional mixing during the freezing process. By mixing the cooled and coloured water during the freezing process, the inclusion of gas bubbles in the ice cubes is avoided and crystal clear ice cubes are formed.

In a preferred embodiment, the freezing means comprises at least one freezing element, which can be cooled for producing ice cubes and heated for discharging the ice cubes from the freezing element. Preferably, each freezing means comprises an array of freezing elements, which are associated. Said freezing elements are preferably intended to be immersed in the cooled and coloured water. Typically, the freezing elements are of an essentially cylindrical form and comprise a metal outer surface. The cross section of the freezing elements is preferably circular to give ice cubes with a circular cross section, but other cross section shapes are possible, such as triangle, oval, square, heart or star shaped cross-sections, for instance. Upon cooling of the freezing elements, ice cubes are formed around the freezing elements. The size of the ice cubes is determined by the time period, during which the freezing elements are cooled. Upon slight heating of the freezing elements, the ice cubes disengage from the surface of the freezing elements and are discharged.

Alternatively, it is also possible that the cooled and coloured water is sprayed onto the freezing elements by a spraying means, such as a spray nozzle, for instance. Preferably, the spraying means is arranged within the freezing means. With the cooled and coloured water having a temperature just above freezing point, the water will almost immediately freeze and stick to the freezing elements. By using several spraying means for the same freezing elements, it is even possible to apply water of different colour at the same time, thereby forming multi-coloured ice cubes. Preferably, the spraying means are movable about the freezing means, thus allowing the spraying from different angles. In this way, ice cubes with a painting or writing, such as a logo, can be formed. Furthermore, it is possible to the determine the shape of the ice cubes formed on the freezing elements by applying more or less cooled and coloured water from one direction or an other.

In a preferred embodiment, the at least one freezing element is movable. Preferably, if the freezing means comprises a freezing chamber, the at least one freezing element is movable also outside the freezing chamber. With a movable freezing element, it is possible to cool the freezing element for forming ice cubes in one area of the apparatus of the present invention, preferably in a freezing chamber, and to heat the freezing element for discharging the ice cubes in a different area of the apparatus, preferably outside the freezing chamber. It is therefore possible to store the cooled and coloured water in a freezing chamber and to transfer the ice cubes formed from the freezing chamber to an ice cube storage or a bag, for instance, by means of the freezing element. In addition, it is also possible to move the freezing element from one freezing chamber to another prior to discharging the ice cube, thereby forming several layers of differently coloured ice on the freezing element. In this manner, multicoloured ice cubes can be prepared. In order to form the coloured ice cubes, the movable freezing element(s) can be suspended in the cooled and coloured water or the later can be sprayed onto the freezing element(s).

In a preferred embodiment, the apparatus of the present invention further comprises at least one water storage means, which is connected to the freezing means, for storing the cooled and coloured water. Such a water storage means is preferably well insulated, and may also be cooled. The water storage means is particularly well suited for storing cooled and coloured water between two freezing cycles: As soon as the ice cubes formed have reached the desired thickness, the remaining water is removed from the freezing means and transferred to the water storage means. Preferably, the apparatus of the present invention comprises an array of two or more water storage means, and most preferably the number of water storage means is equal to the number of freezing means. In the latter case, it is preferred that each freezing means is connect to one water storage means. Alternatively, the number of water storage means may also be equal to the number of colour recipients, with each water storage means being intended for storing water of one particular colour to avoid blending of the colours.

In a preferred embodiment, the apparatus of the present invention further comprises at least one ice storage means for storing the coloured ice cubes. The ice cubes are preferably stored in said ice storage means until needed. The ice storage means is cooled to below 0° C., preferably below 5° C., in order to avoid melting of the ice cubes stored therein.

Preferably, the apparatus of the present invention further comprises a hands free dispenser system, such that the ice cubes can be dispensed and packaged automatically without human contact to avoid contamination of the ice.

In a preferred embodiment, the apparatus of the present invention further comprises a water filter, which is arranged between the connection for the water supply and the heating means. The water filter allows for an additional purification of the water supplied to the apparatus.

In a preferred embodiment, the apparatus of the present invention further comprises a control unit, which is preferably microprocessor-controlled. The control unit is used for controlling the water supply, the heating means, the colour recipients, the freezing means and/or the cooling means, and, if applicable, also the water pumps, the mixing means, the freezing elements, the water storage means and/or the ice storage means. In particular, the control unit can be used for controlling the amount of water supplied to the heating means, the colour recipients, the cooling means, the freezing means and/or the water storage means, for instance by opening and closing the pertaining water in- and/or outlets or the water pumps pumping the water from one component to another. The control unit may also be used for controlling the amount of colouring agent added to the hot water in the colour recipients and for determining the colour of the ice cubes to be formed, and the amount of ice cubes prepared of each colour. Equally, the control unit is suited for controlling the size of the ice cubes formed. Preferably, the control unit is used for preparing coloured ice cubes on demand, such that ice cubes in a desired colour, amount and size are prepared upon entering a corresponding command.

In addition, the apparatus of the present invention may also comprise one or more sensors, for example a flow rate sensor for measuring the amount of water transferred from one component to another, a sensor measuring the thickness of the ice cubes formed on the freezing elements, a temperature sensor or a filling level meter for determining the filling level of the water and ice cubes, respectively, in the heating tank, the cooling tank, the freezing chambers and the ice cube storage means, for instance.

In a further aspect, the present invention also relates to a method for operating the apparatus of the present invention. For operation, cold water is supplied to the heating means and is heated to a temperature of ≥70° C. to afford hot water; a first amount of the hot water is supplied to at least one colour recipient and is brought into contact with a colouring agent to afford coloured water; a second amount of the hot water is supplied to the cooling means and is cooled to a temperature of ≤10° C. to afford cooled water; and the coloured water from said at least one colour recipient is combined with an amount of cooled water and supplied to a freezing means to afford coloured ice cubes.

In a preferred embodiment, the colouring agent is a food grade colouring agent prepared by drying one or more coloured vegetable materials selected from the group consisting of red cabbage, beetroot, lemon, black currant, red currant, strawberry, blackberry, blueberry, cranberry, and saffron. Such a food grade colouring agent is described in EP 09 002 501, the entire disclosure of which is herewith incorporated by reference.

In a preferred embodiment, the freezing means is supplied successively with coloured water of at least two different colours to afford bi- or multicoloured ice cubes. In this case, several freezing cycles are performed without discharging the ice cubes from the freezing elements. Preferably, a different colour is used for each freezing cycle to provide ice cubes with two or more layers of different colours. Upon melting, for instance in a drink, the bi- or multicoloured ice cubes prepared by the method of the present invention will change their colour. It is also possible to prepare ice cubes with a single- or multicolour core, which is covered with a clear or cloudy layer of colourless ice. For the colourless layer, the freezing means is supplied solely with water from the cooling means. It is well known to a person skilled in the art that the water needs to be stirred during freezing in order to obtain clear ice and that without stirring, due to gas bubbles enclosed in the ice, cloudy ice is formed.

The cooling of the water in the cooling means prior to the actual freezing process is particularly favourable for the formation of bi- or multicoloured ice cubes: Not only is the freezing process much faster, but the colder the water supplied to the freezing means, the better it will adhere to the previous layer and freeze without diluting the previous colour(s).

In a preferred embodiment, a mould or lattice is introduced into the freezing means during the formation of the bi- or multicoloured ice cubes, between two different colours, such that the final, outer shape of the ice cubes corresponds to the mould or lattice, whereas the shape of the inner layers is determined by the shape of the freezing elements. In this manner, it is for instance possible to form a square shaped ice cube with a globular core, in particular an on the outside colourless ice cube having a coloured core. Preferably, the ice cubes formed in this manner are removed from the freezing means by heating both the freezing elements and the mould or lattice at the same time. The mould or lattice can be used both with movable and with steady freezing elements, and is preferably arranged within the freezing means.

DESCRIPTION OF THE DRAWINGS

The subject of the present invention is further illustrated by the following figures, showing.

DETAILED DESCRIPTION OF THE PREFERRED EMBODIMENTS

Figure 1:
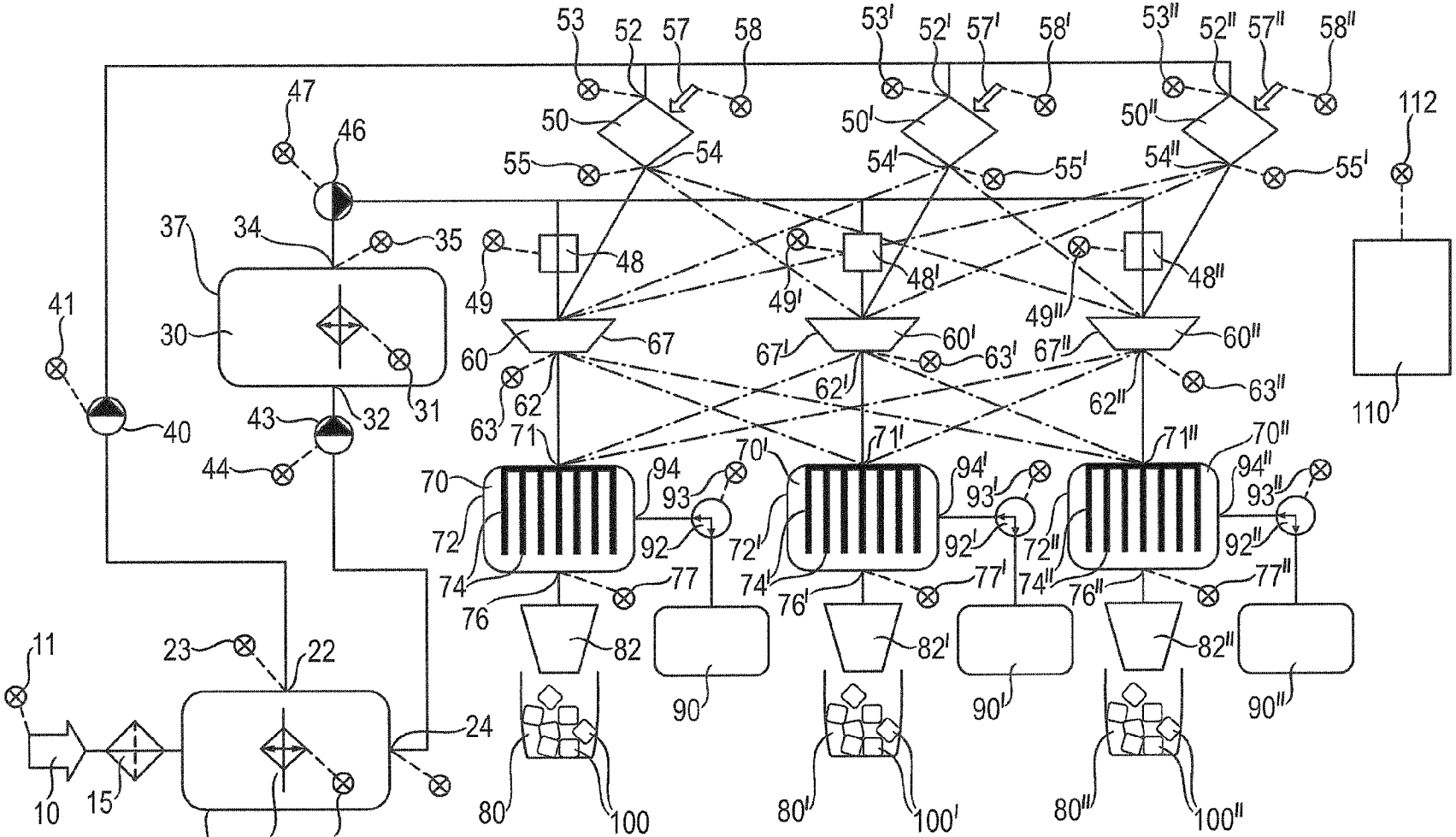
FIG. 1 a first embodiment of an apparatus for the preparation of coloured ice cubes.

The first embodiment of the apparatus of the present invention shown in FIG. 1 comprises a connection for a water supply 10, which is connected to a heating means 20. Between the connection for the water supply 10 and the heating means 20, a filter 15 is arranged for cleaning the water supplied to the apparatus. The connection for the water supply 10 comprises a control connection 11, preferably a valve, which is connected to a control connection 112 of a control unit 110 (the connections to the control unit are shown only allusively for clarity reasons), which is intended to control, and preferably also measure, the amount of water supplied to the apparatus.

The heating means 20 comprises an insulated heating tank 27, a first water outlet 22, which may comprise a valve 23 that can be controlled by the control unit 110, and a second water outlet 24, which comprises a control connection 25 to the control connection 112 of the control unit 110. The heating means 20 is used for heating the water to a temperature of at least 70° C., preferably of at least 90° C. The heating means 20 further comprises a control connection 21, which is connected to the control connection 112 of the control unit 110. Thus, the operation of the heating means 20 can be controlled by the control unit 110. It is also possible to store the water in the heating means 20 until needed. Preferably, the heating means 20 further comprises a filling level meter (not shown).

The first water outlet 22 is connected to an array of colour recipients 50, 50', 50", such that, by means of a first water pump 40, which is arranged between the heating means 20 and the colour recipients 50, 50', 50" and comprises a control connection 41 to the control connection 112 of the control unit 110, hot water can be discharged from the heating means 20 and supplied to the colour recipients 50, 50', 50". The amount of water transferred from the heating means 20 to the colour recipients 50, 50', 50" can be controlled, and preferably also measured, for instance by means of a flow rate sensor, by the control unit 110.

The second water outlet 24 of the heating means 20 is connected to a cooling means 30, such that, by means of a second water pump 43, which is arranged between the heating means 20 and the cooling means 30 and comprises a control connection 44 to the control connection 112 of the control unit 110, hot water can be discharged from the heating means 20 and supplied to the cooling means 30. The amount of water discharged from the heating means 20 by the first water outlet 22 or the second water outlet 24 can be controlled, and preferably also measured, for instance by means of a flow rate sensor, by the control unit 110.

The colour recipients 50, 50', 50" each comprise a water inlet 52, 52', 52", which comprises a valve 53, 53', 53" to the control connection 112 of the control unit 110, and a water outlet 54, 54', 54", which comprises a control element 55, 55', 55", preferably in the form of a pilot valve, to the control connection 112 of the control unit 110. Alternatively, it is also possible that a separate valve is arrange between the water outlet 54, 54', 54" and each mixing means 60, 60', 60" connected thereto.

The water inlets 52, 52', 52" are each connected to the first water outlet 22 of the heating means 20. The amount of water supplied to each colour recipient 50, 50', 50" via the water inlets 52, 52', 52" can be controlled, and preferably also measured, by the control unit 110. Each of the colour recipients 50, 50', 50" further comprises a colour supply 57, 57', 57", which allows for the introduction of a colouring agent into the colour recipients 50, 50', 50" and comprises a control connection 58, 58', 58" to the control connection 112 of the control unit 110. Preferably, each colour recipient 50, 50', 50" is supplied with a colouring agent of a different colour. The amount of colouring agent supplied to the colour recipients 50, 50', 50" can be measured and controlled by the control unit 110. In the colour recipients 50, 50', 50", the coloured water is prepared from the hot water. The water outlets 54, 54', 54" of the colour recipients 50, 50', 50" are connected to an array of mixing means 60, 60', 60". Preferably, each water outlet 54, 54', 54" is connected with all mixing means 60, 60', 60". The amount of coloured water discharged from the colour recipients 50, 50', 50" via the water outlets 54, 54', 54" to each mixing means 60, 60', 60" can be controlled, and preferably also measured by means of a flow rate sensor, for instance, by the control unit 110.

The cooling means 30 comprises an insulated cooling tank 37, a water inlet 32 and a water outlet 24, which may comprise a valve 35 that is connected to the control connection 112 of the control unit 110. In the cooling means 30, the water is cooled to a temperature of less than 10° C., preferably less than 5° C. The cooling means 30 further comprises a control connection 31, which is connected to the control connection 112 of the control unit 110. Thus, the operation of the cooling means 30 can be controlled by the control unit 110. It is also possible to store the cooled water in the cooling means 30 until needed. Preferably, the cooling means 30 further comprises a filling level meter (not shown).

The water outlet 34 of the cooling tank 30 is connected to the array of mixing means 60, 60', 60". By means of a third water pump 46, which comprises a control connection 45 to the control connection 112 of the control unit 110, cooled water is pumped from the cooling means 30 via the water outlet 34 to the mixing means 60, 60', 60". Between the cooling tank 30 and each mixing means 60, 60', 60", there is a valve 48, which comprises a control connection 49 that is connected to the control connection 112 of the control unit 110. Therefore, the amount of water supplied to each mixing means 60, 60', 60" can be controlled, and preferably also measured, by the control unit 110.

In the mixing means 60, 60', 60", which comprises a mixing chamber 67, 67', 67", the coloured water from the colour recipients 50, 50', 50" is mixed with the cooled water from the cooling means 30, preferably by means of a stirring device (not shown). Each of the mixing means 60, 60', 60" comprises a water outlet 62, 62', 62", which comprises a control element 63, 63', 63", preferably in the form of a pilot valve, to the control connection 112 of the control unit 110. Alternatively, it is also possible that a separate valve is arranged between the water outlet 62, 62', 62" and each freezing means 70, 70', 70" connected thereto. The water outlets 62, 62', 62" of the mixing means 60, 60', 60" are connected to an array of freezing means 70, 70', 70"; preferably, each mixing means 60, 60', 60" is connected with all freezing means 70, 70', 70". The amount of mixed water supplied from the mixing means 60, 60', 60" to the freezing means 70, 70', 70" can be controlled, and preferably also measured, by the control unit 110.

Each freezing means 70, 70', 70" comprises an insulated freezing chamber 72, 72', 72", a water inlet 71, 71', 71", which is connected to the mixing means 60, 60', 60", and bar-shaped freezing elements 74, 74', 74". Preferably, each of the freezing means 70, 70', 70" also comprises a further mixing means, preferably a stirring device (not shown). In the freezing means 70, 70', 70", coloured ice cubes 100, 100', 100" are prepared from the mixed water. For this purpose, the freezing elements 74, 74', 74" are immersed in the mixed coloured water and cooled until coloured ice cubes 100, 100', 100" of a desired size have formed thereon. Preferably, the mixed water is stirred during the freezing process. In addition, the thickness of the ice cubes 100, 100', 100" is preferably measured by means of a sensor (not shown) and controlled by the control unit 110.

Once the coloured ice cubes 100, 100', 100" have reached the desired size, the remaining water is removed from the freezing chambers 72, 72', 72" via a water outlet 94, 94', 94" of the freezing means 70, 70', 70" and, by means of a fourth water pump 92, 92', 92", pumped to a water storage means 90, 90', 90", which is connected to the freezing means 70, 70', 70". Preferably, each freezing means 70, 70', 70" is connected to one separate water storage means 90, 90', 90". The fourth water pumps 92, 92', 92" each comprise a control connection 93, 93', 93" to the control connection 112 of the control unit 110. The amount of water discharged from the freezing means 70, 70', 70" and pumped to the water storage means 90, 90', 90" can thus be controlled, and preferably also measured by means of a flow rate sensor, by the control unit 110. In addition, the fourth water pumps 92, 92', 92" also allow for reintroducing the water into the freezing means 70, 70', 70" from the water storage means 90, 90', 90", once the coloured ice cubes 100, 100', 100" have been removed. Preferably, each freezing chambers 72, 72', 72" further comprises a filling level meter (not shown).

Each freezing means 70, 70', 70" further comprises an ice outlet 76, 76', 76", which comprises a control connection 77, 77', 77" to the control connection 112 of the control unit 110. From the freezing means 70, 70', 70", the coloured ice cubes 100, 100', 100" are discharged, upon heating the freezing elements 74, 74', 74", via the ice outlet 76, 76', 76" through a funnel 82, 82', 82" into an ice storage means 80, 80', 80". The discharging of the coloured ice cubes 100, 100', 100" can be controlled by the control unit 110. Preferably, the ice storage means 80, 80', 80" comprises a filling level meter (not shown). It is also possible that the coloured ice cubes 100, 100', 100" are directly supplied to a packaging unit (not shown) and packaged for sale, for instance in plastic bags. Preferably, the coloured ice cubes 100, 100' and 100", respectively, from the different freezing means 70, 70' and 70", respectively, have different colours. Alternatively, it is also possible to combine ice cubes 100, 100', 100" of different colours to obtain assorted mixtures.

It is also possible that each water storage means 90, 90', 90" is connected to two or more freezing means 70, 70', 70", such that the coloured water con be transferred from one freezing means 70, 70', 70" via a water storage means 90, 90', 90" to another freezing means 70, 70', 70". Thanks to this alternative arrangement, it is possible to produce bi- or multicoloured ice cubes 100, 100', 100": After a first freezing cycle with water of a first colour, the remaining water is discharged from the freezing means 70, 70', 70" and water of a different second colour is introduced without discharging the ice cubes 100, 100', 100" from the freezing elements 74, 74', 74" intermittently, and a second freezing cycle is performed and so forth. Thereby, ice cubes 100, 100', 100" with several layers of different colours can be produced.

Figure 2:
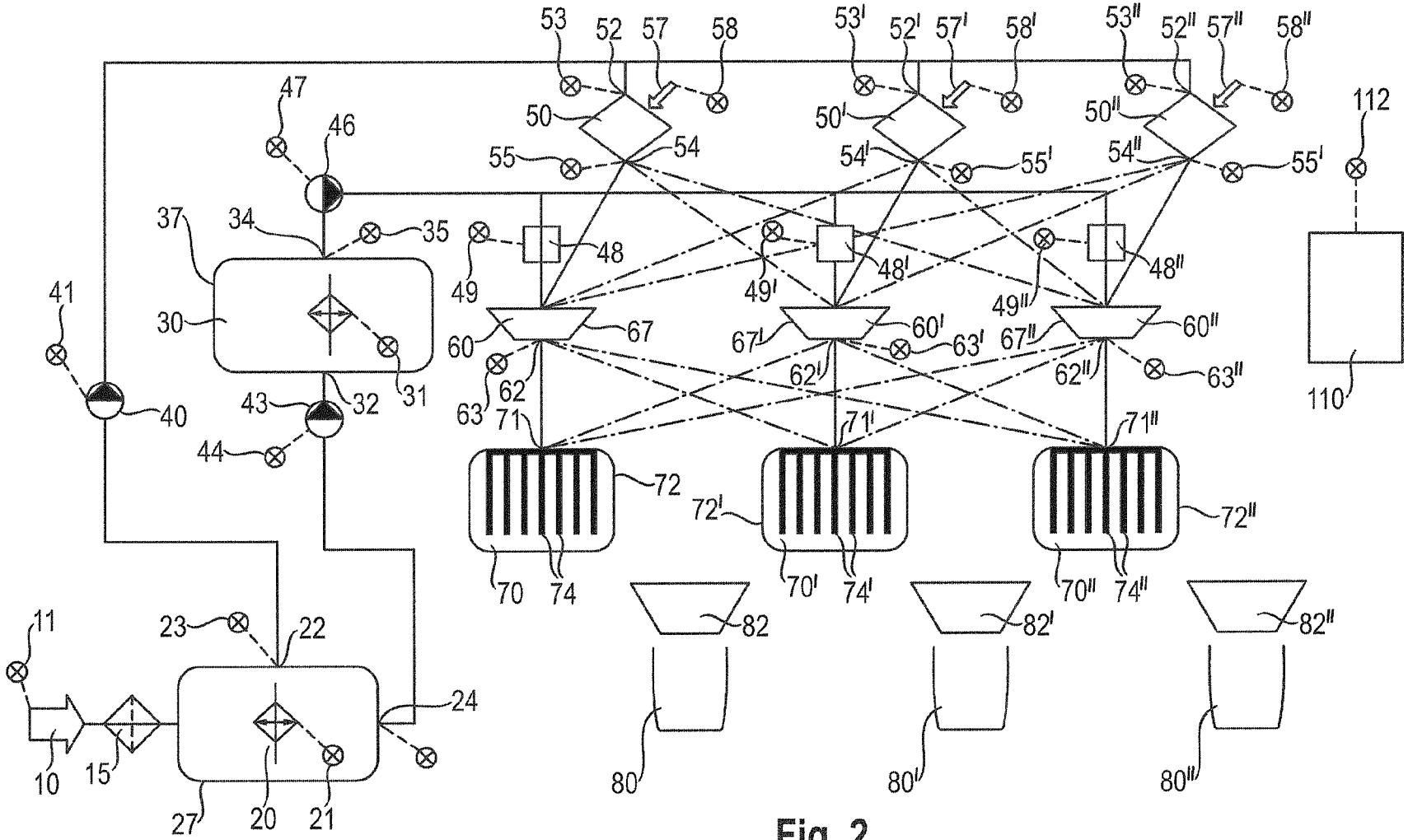
FIG. 2 a second embodiment of an apparatus for the preparation of coloured ice cubes.
Figure 3:
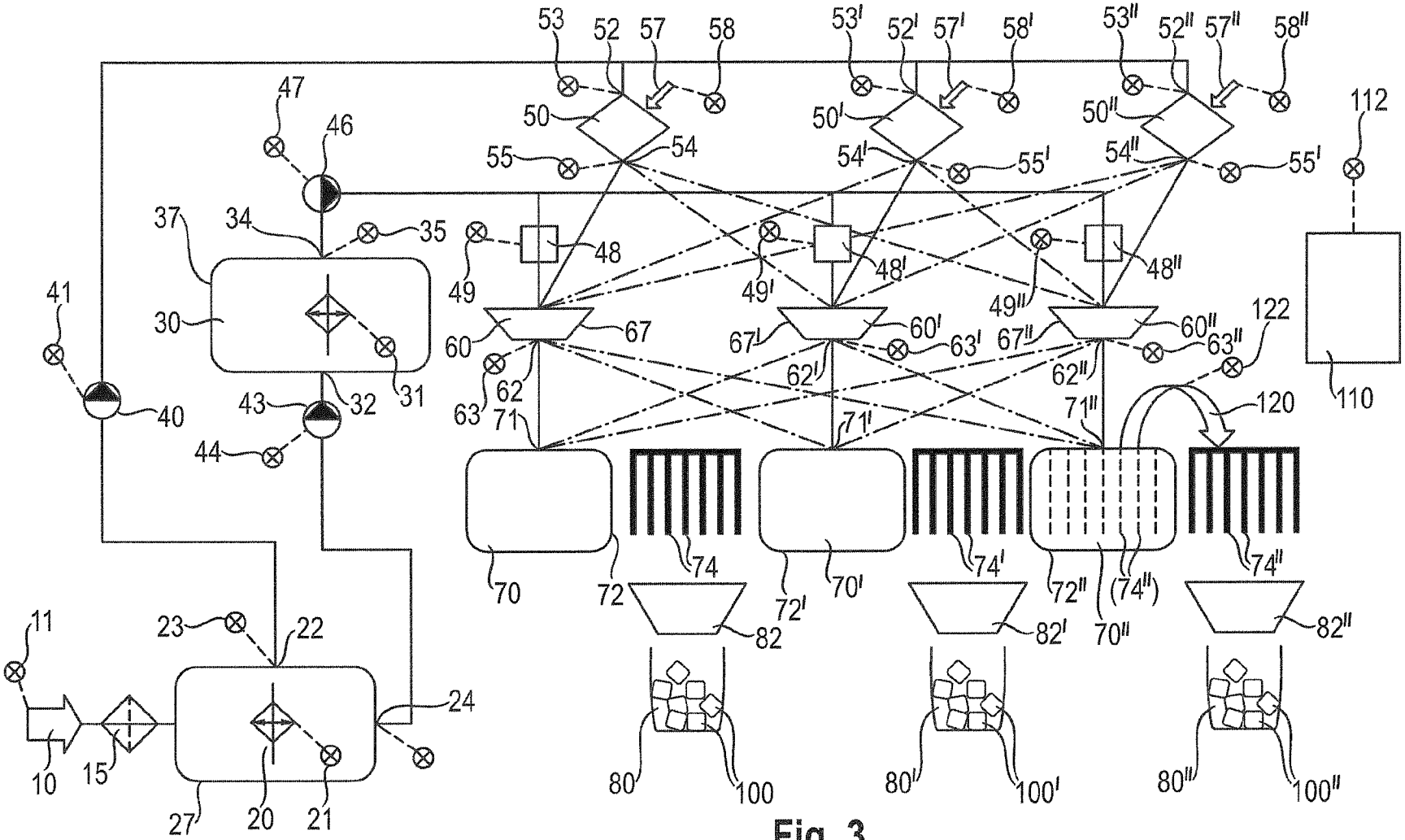
FIG. 3 the second embodiment of FIG. 2, wherein the prepared ice cubes are discharged.

FIGS. 2 and 3 show a second embodiment of the apparatus of the present invention. In FIG. 2, the apparatus is shown during a freezing cycle or in the resting state, whereas FIG. 3 shows the discharging of coloured ice cubes 100, 100', 100" from freezing elements 74, 74', 74".

The second embodiment of the apparatus of the present invention shown in FIGS. 2 and 3 comprises a connection for a water supply 10, which is connected to a heating means 20. Between the connection for the water supply 10 and the heating means 20, a filter 15 is arranged for cleaning the water supplied to the apparatus. The connection for the water supply 10 comprises a control connection 11, preferably a valve, which is connected to a control connection 112 of a control unit 110 (the connections to the control unit are shown only allusively for clarity reasons), which is intended to control, and preferably also measure, the amount of water supplied to the apparatus.

The heating means 20 comprises an insulated heating tank 27, a first water outlet 22, which may comprise a valve 23 that can be controlled by the control unit 110, and a second water outlet 24, which comprises a control connection 25 to the control connection 112 of the control unit 110. The heating means 20 is used for heating the water to a temperature of at least 70° C., preferably of at least 90° C. The heating means 20 further comprises a control connection 21, which is connected to the control connection 112 of the control unit 110. Thus, the operation of the heating means 20 can be controlled by the control unit 110. It is also possible to store the water in the heating means 20 until needed. Preferably, the heating means 20 further comprises a filling level meter (not shown).

The first water outlet 22 is connected to an array of colour recipients 50, 50', 50", such that, by means of a first water pump 40, which is arranged between the heating means 20 and the colour recipients 50, 50', 50" and comprises a control connection 41 to the control connection 112 of the control unit 110, hot water can be discharged from the heating means 20 and supplied to the colour recipients 50, 50', 50". The amount of water transferred from the heating means 20 to the colour recipients 50, 50', 50" can be controlled, and preferably also measured, for instance by means of a flow rate sensor, by the control unit 110.

The second water outlet 24 of the heating means 20 is connected to a cooling means 30, such that, by means of a second water pump 43, which is arranged between the heating means 20 and the cooling means 30 and comprises a control connection 44 to the control connection 112 of the control unit 110, hot water can be discharged from the heating means 20 and supplied to the cooling means 30. The amount of water discharged from the heating means 20 by the first water outlet 22 or the second water outlet 24 can be controlled, and preferably also measured, for instance by means of a flow rate sensor, by the control unit 110.

The colour recipients 50, 50', 50" each comprise a water inlet 52, 52', 52", which comprises a valve 53, 53', 53" to the control connection 112 of the control unit 110, and a water outlet 54, 54', 54", which comprises a control element 55, 55', 55", preferably in the form of a pilot valve, to the control connection 112 of the control unit 110. Alternatively, it is also possible that a separate valve is arrange between the water outlet 54, 54', 54" and each mixing means 60, 60', 60" connected thereto.

The water inlets 52, 52', 52" are each connected to the first water outlet 22 of the heating means 20. The amount of water supplied to each colour recipient 50, 50', 50" via the water inlets 52, 52', 52" can be controlled, and preferably also measured, by the control unit 110. Each of the colour recipients 50, 50', 50" further comprises a colour supply 57, 57', 57", which allows for the introduction of a colouring agent into the colour recipients 50, 50', 50" and comprises a control connection 58, 58', 58" to the control connection 112 of the control unit 110. Preferably, each colour recipient 50, 50', 50" is supplied with a colouring agent of a different colour. The amount of colouring agent supplied to the colour recipients 50, 50', 50" can be measured and controlled by the control unit 110. In the colour recipients 50, 50', 50", the coloured water is prepared from the hot water. The water outlets 54, 54', 54" of the colour recipients 50, 50', 50" are connected to an array of mixing means 60, 60', 60". Preferably, each water outlet 54, 54', 54" is connected with all mixing means 60, 60', 60". The amount of coloured water discharged from the colour recipients 50, 50', 50" via the water outlets 54, 54', 54" to each mixing means 60, 60', 60" can be controlled, and preferably also measured by means of a flow rate sensor, for instance, by the control unit 110.

The cooling means 30 comprises an insulated cooling tank 37, a water inlet 32 and a water outlet 24, which may comprise a valve 35 that is connected to the control connection 112 of the control unit 110. In the cooling means 30, the water is cooled to a temperature of less than 10° C., preferably less than 5° C. The cooling means 30 further comprises a control connection 31, which is connected to the control connection 112 of the control unit 110. Thus, the operation of the cooling means 30 can be controlled by the control unit 110. It is also possible to store the cooled water in the cooling means 30 until needed. Preferably, the cooling means 30 further comprises a filling level meter (not shown).

The water outlet 34 of the cooling tank 30 is connected to the array of mixing means 60, 60', 60". By means of a third water pump 46, which comprises a control connection 45 to the control connection 112 of the control unit 110, cooled water is pumped from the cooling means 30 via the water outlet 34 to the mixing means 60, 60', 60". Between the cooling tank 30 and each mixing means 60, 60', 60", there is a valve 48, which comprises a control connection 49 that is connected to the control connection 112 of the control unit 110. Therefore, the amount of water supplied to each mixing means 60, 60', 60" can be controlled, and preferably also measured, by the control unit 110.

In the mixing means 60, 60', 60", which comprises a mixing chamber 67, 67', 67", the coloured water from the colour recipients 50, 50', 50" is mixed with the cooled water from the cooling means 30, preferably by means of a stirring device (not shown). Each of the mixing means 60, 60', 60" comprises a water outlet 62, 62', 62", which comprises a control element 63, 63', 63", preferably in the form of a pilot valve, to the control connection 112 of the control unit 110. Alternatively, it is also possible that a separate valve is arranged between the water outlet 62, 62', 62" and each freezing means 70, 70', 70" connected thereto. The water outlets 62, 62', 62" of the mixing means 60, 60', 60" are connected to an array of freezing means 70, 70', 70"; preferably, each mixing means 60, 60', 60" is connected with all freezing means 70, 70', 70". The amount of mixed water supplied from the mixing means 60, 60', 60" to the freezing means 70, 70', 70" can be controlled, and preferably also measured, by the control unit 110.

Each freezing means 70, 70', 70" comprises an insulated freezing chamber 72, 72', 72", a water inlet 71, 71', 71", which is connected to the mixing means 60, 60', 60", and bar-shaped freezing elements 74, 74', 74". Preferably, each of the freezing means 70, 70', 70" also comprises a further mixing means, preferably a stirring device (not shown). In the freezing means 70, 70', 70", coloured ice cubes 100, 100', 100" are prepared from the mixed water. For this purpose, the freezing elements 74, 74', 74" are immersed in the mixed coloured water and cooled until coloured ice cubes 100, 100', 100" of a desired size have formed thereon. Preferably, the mixed water is stirred during the freezing process. In addition, the thickness of the ice cubes 100, 100', 100" is preferably measured by means of a sensor (not shown) and controlled by the control unit 110.

Once the coloured ice cubes 100, 100', 100" have reached the desired size, the freezing elements 74, 74', 74" with the ice cubes 100, 100', 100" thereon are moved out of the freezing chambers 72, 72', 72" by means of a driving means 120 (shown only once for clarity reasons), while the remaining water from is not removed from the freezing chambers 72, 72', 72". The driving means 120 comprises a control connection 122 to the control connection 112 of the control unit 110 and can thus be controlled by the control unit 110. Outside of the freezing chambers 72, 72', 72", the freezing elements 74, 74', 74" are heated for discharging the coloured ice cubes 100, 100', 100" through a funnel 82, 82', 82" into an ice storage means 80, 80', 80". The discharging of the coloured ice cubes 100, 100', 100" can be controlled by the control unit 110. Preferably, the ice storage means 80, 80', 80" comprises a filling level meter (not shown). It is also possible that the coloured ice cubes 100, 100', 100" are directly supplied to a packaging unit (not shown) and packaged for sale, for instance in plastic bags. Preferably, the coloured ice cubes 100, 100' and 100", respectively, from the different freezing means 70, 70' and 70", respectively, have different colours. Alternatively, it is also possible to combine ice cubes 100, 100', 100" of different colours to obtain assorted mixtures. After discharging the ice-cubes from the freezing elements 74, 74', 74", the latter are moved back into the freezing chambers 72, 72', 72" by means of the driving means 120, and a new freezing cycle can be started.

The freezing chambers 72, 72', 72" may further comprise a drain valve (not shown), such that the cooled and coloured water can be completely removed from the freezing chambers 72, 72', 72", for instance for cleaning purposes.

It is also possible that after a first freezing cycle, the freezing elements 74, 74', 74" are moved from one freezing chamber 72, 72', 72" to another, without discharging the ice cubes 100, 100', 100" from the freezing elements 74, 74', 74" intermittently, and performing a second freezing cycle and so forth. In this manner, it is possible to produce bi- or multicoloured ice cubes 100, 100', 100": If the first and second freezing cycles are performed in two or more freezing chamber 72, 72', 72" with water of two or more different colours, ice cubes 100, 100', 100" with several layers of different colours are produced.

The invention claimed is:

1. An apparatus for the preparation of coloured ice cubes, comprising:

a connection for a water supply;

a single central heating means;

an array of two or more colour recipients intended for receiving a colouring agent, each colour recipient comprising a colour recipient water inlet and a colour recipient water outlet for discharging coloured water; and, at least one freezing means for preparing coloured ice cubes;

wherein the single central heating means is connected to the connection for the water supply for feeding the heating means with water, the single central heating means comprising a heating means water outlet for discharging hot water, the heating means water outlet being connected to each of the colour recipient water inlets for feeding the colour recipients with hot water; and, wherein the apparatus further comprises a single central cooling means, the single central cooling means having a cooling means water inlet, the cooling means water inlet being connected to the connection for the water supply for feeding the single central cooling means with water, and the single central cooling means also comprising a cooling means water outlet for discharging cooled water; and, said apparatus further comprising an array of two or more mixing means, each of the mixing means in the array of two or more mixing means corresponding to a colour recipient in the array of two or more colour recipients, for mixing the coloured water with the cooled water, each of the mixing means in the array of two or more mixing means comprising a mixing means water inlet for receiving coloured water discharged from the corresponding colour recipient in the array of two or more colour recipients, each mixing means further comprising a mixing means water inlet for cooled water discharged from the single central cooling means, and each mixing means in the array of two or more mixing means further comprising a mixing means water outlet connected to the at least one freezing means.

2. The apparatus according to claim 1, wherein the heating means comprises a heating tank.

3. The apparatus according to claim 1, wherein the cooling means comprises a cooling tank.

4. The apparatus according to claim 1, wherein the water inlet of the cooling means is connected to the water outlet of the heating means.

5. The apparatus according to claim 1, further comprising one or more water pumps for pumping the water from at least one of: the heating means to each of the colour recipients; the cooling means to the at least one freezing means; and the heating means to the cooling means.

6. The apparatus according to claim 1, wherein the at least one freezing means is an array of two or more freezing means.

7. The apparatus according to claim 1, wherein the at least one freezing means is connected to at least two of the colour recipient water outlets.

8. The apparatus according to claim 1, wherein the at least one freezing means comprises at least one freezing chamber.

9. The apparatus according to claim 1, further comprising at least one water storage means, which is connected to the at least one freezing means, for storing the cooled and coloured water discharged from the array of two more mixing means.

10. The apparatus according to claim 1, further comprising at least one ice storage means for storing the coloured ice cubes.

11. The apparatus according to claim 1, further comprising a water filter, which is arranged between the connection for the water supply and the heating means.

12. The apparatus according to claim 1, wherein the at least one freezing means comprises an array of two or more freezing chambers.

13. The apparatus according to claim 1, wherein the at least one mixing means in the array of two or more mixing means is configured to receive coloured water from more than one of the colour recipients.

14. The apparatus according to claim 13, wherein at least one mixing means is arranged within a mixing chamber or within a freezing chamber.

15. The apparatus according to claim 1, further comprising a control unit, for controlling the water supply, the heating means, the array of two or more colour recipients, the array of two or more mixing means, and the at least one freezing means and the single central cooling means.

16. The apparatus according to claim 15, wherein the control unit is microprocessor-controlled.

17. The apparatus according to claim 1, wherein the at least one freezing means comprises at least one freezing element, which can be cooled for producing ice cubes and heated for discharging the ice cubes from the at least one freezing element.

18. The apparatus according to claim 17, wherein the at least one freezing element is movable.

19. The apparatus according to claim 17, wherein the at least one freezing element is movable to a position which is outside the freezing chamber.

* * * * *